United States Patent [19]

Theiler

[11] 4,236,330

[45] Dec. 2, 1980

[54] IRONING INSTALLATION AND METHOD OF OPERATING THE SAME

[76] Inventor: Robert Theiler, L'Oree du bois, 68360 Soultz, France

[21] Appl. No.: 4,738

[22] Filed: Jan. 18, 1979

[30] Foreign Application Priority Data

Jan. 24, 1978 [CH] Switzerland ..... 723780/78

[51] Int. Cl.[2] ..... D06F 69/02

[52] U.S. Cl. ..... 38/8; 38/14; 38/144

[58] Field of Search ..... 38/8, 9, 11, 14, 44, 38/49, 50, 51, 144

[56] References Cited

U.S. PATENT DOCUMENTS

| | | | |
|---|---|---|---|
| 2,460,496 | 2/1949 | Forse | 38/9 X |
| 3,510,971 | 5/1970 | Brauetti | 38/8 |

FOREIGN PATENT DOCUMENTS

| | | |
|---|---|---|
| 92696 | 5/1923 | Austria . |
| 495188 | 8/1950 | Belgium . |
| 61489 | 3/1892 | Fed. Rep. of Germany . |
| 199707 | 6/1908 | Fed. Rep. of Germany . |
| 468074 | 11/1928 | Fed. Rep. of Germany . |
| 1427970 | 1/1966 | France . |
| 361155 | 11/1931 | United Kingdom . |
| 475286 | 11/1937 | United Kingdom . |
| 689639 | 4/1953 | United Kingdom . |
| 1113110 | 5/1968 | United Kingdom . |

*Primary Examiner*—Louis Rimrodt

*Attorney, Agent, or Firm*—Werner W. Kleeman

[57] ABSTRACT

An ironing installation possessing an ironing machine having two hollow rolls and four heating elements which can be heated by water vapor. During operation water vapor and hot air are sucked into the rolls through holes at the roll shells or jackets. This water vapor-air mixture is expelled to the surroundings through a heat exchanger. Ambient air is sucked into an air infeed line or conduit and infed through the heat exchanger into the internal compartment of a casing which at least partially encloses the rolls and heating elements. Between the aforementioned heat exchanger and an outlet opening or mouth of the air infeed line there is arranged a passage of a second heat exchanger in the air infeed line. A further passage of this second heat exchanger is connected with outlets of the four heating elements.

7 Claims, 1 Drawing Figure

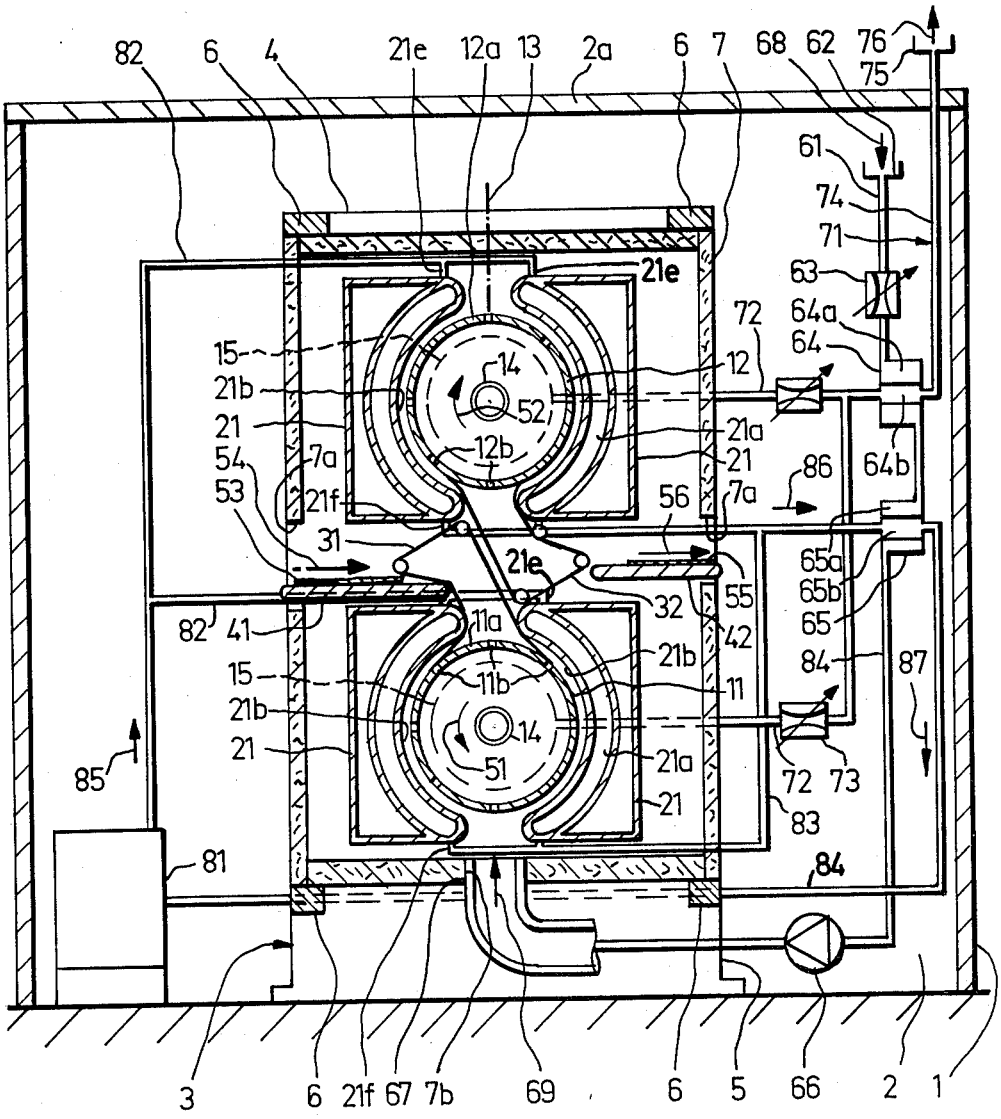
82
6
4
21e
12a
13
2a
6
7
68
62
76
75
61
74
71
63
64a
64
72
21e
15
21b
21
54
53
14
52
12b
7a
21f
12
21a
21
7a
86
64b
56
31
21e
32
55
65a
65b
65
42
82
41
11a
21b
84
87
15
11b
11
21b
14
21
51
21a
21
85
72
73
83
81
84
3
6
21f
67
7b
69
6
5
66
2
1

IRONING INSTALLATION AND METHOD OF OPERATING THE SAME

BACKGROUND OF THE INVENTION

The present invention relates to a new and improved construction of an ironing installation comprising an ironing machine equipped with at least one rotatably mounted roll and at least one heating element having a heating surface, in order to heat the textile pieces or the like which are to be ironed and to press such against each roll, each roll having a jacket or outer surface provided with holes which are connected with a suction line or conduit equipped with a suction device.

During operation of ironing installations of the previously mentioned type the textile pieces which are to be ironed or pressed are infed in a moist condition to the ironing machine. During the ironing operation, i.e., when a textile piece is located between a roll and a heating element, the water contained in the textile piece is vaporized. The formed water vapor together with air is removed by suction from the surrounding region of the related roll and expelled into the ambient surroundings through a suction line out of the building where there is arranged the ironing machine.

With heretofore known ironing installations the air which is removed by suction at the same time with the water vapor is directly sucked out of the room where there has been erected the ironing machine. This air, after it has reached the heating surfaces, possesses a room temperature which is in the order of about 20° C. to 25° C. The sucked-off room air must be heated to a temperature of at least 100° C., in order to enable the water to vaporize and to further ensure that the water vapor does not immediately again condense. This is associated with a number of different drawbacks. Firstly, there is increased the energy consumption of the heating elements, because such not only must vaporize the water, but also must heat the sucked-up air. In winter, when it is necessary to heat the work room containing the ironing machine, sucking up of air out of the work room additionally requires an increase of the heating energy needed for heating the work room or area.

Furthermore, due to the requisite heating of the sucked-off air there is also unfavorably affected the maximum possible ironing speed of the ironing machine. After entry of a textile piece between the roll and the heating surface of a heating element there only then is initiated the complete ironing effect if the air which flows in between the roll and the heating surface has been heated to at least 100° C. This means that the complete ironing action or effect only arises during part of the time that the textile piece is located between a roll and its related heating surface.

SUMMARY OF THE INVENTION

Therefore, with the foregoing in mind it is a primary object of the present invention to provide and new and improved construction of ironing installation and method of operating the same which effectively eliminates the previously mentioned drawbacks and limitations.

Another and more specific object of the present invention aims at providing a new and improved construction of ironing installation and method of operating the same, which enables ironing textile pieces or the like with reduced energy consumption and with a more effective ironing action.

Now in order to implement these and still further objects of the invention, which will become more readily apparent as the description proceeds, the invention contemplates providing a heating exchanger having two passageways or passages for two flow media, whose heat is to be exchanged. The one passageway of the heat exchanger forms part of an air infeed line or conduit which is equipped with an air inlet, a pump and at least one outlet opening or mouth. This outlet opening or mouth is disposed at the ironing machine at the region of the rolls and heating element, and the other passageway of the heat exchanger is arranged at a suction line or conduit.

During operation of the invention ironing installation the heat of the sucked-off and removed water vapor and the thus sucked-off air at least partially can again be reclaimed and used for heating air which is infed to the ironing machine at the region of the rolls and heating elements. The infeed of hot air renders it possible to iron the textile pieces with a greater rotational speed of the rolls than would be otherwise possible. Additionally, due to the reclaiming of the heat or thermal energy there is improved the energy balance, which has a favorable effect upon the operating costs of the installation.

Further details of the ironing installation which provide for a particularly large reduction of the energy consumption and a large increase of the ironing efficiency of the ironing machine, while retaining essentially the same total size of the heating element-heating surfaces of the ironing machine, will be discussed more fully hereinafter as the description proceeds.

Further, the invention is concerned with a novel method of operating the ironing installation wherein the ironing machine is operated in a room or area of a building, vapor and air are sucked-off through the suction line and expelled into the surroundings of the building, and air is sucked-up into the air infeed line out of the room where there is arranged the ironing machine.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing schematically shows in sectional view the ironing machine of the ironing installation of the present invention along with further elements constituting part of the inventive ironing installation.

DETAILED DESCRIPTION OF THE PREFERRED EMBODIMENT

Describing now the drawing, in the single FIGURE thereof reference character 1 designates a building or structure containing an area where there is housed an ironing installation designed according to the invention. This ironing installation comprises at least one ironing machine 3 which is erected at a room or area 2 of the building 1. The ironing machine 3 is provided with a frame or housing 4 containing two essentially vertical side elements 5 which are interconnected by traverses or crossties 6. Now at the frame 4 there have been shown in only markedly simplified illustration substantially hollow cylindrical rolls 11 and 12, specifically a first roll 11 and a second roll 12 which are appropriately mounted for rotation at the frame 4. Both of the rolls 11 and 12 have rotational axes which extend essentially in parallelism and are dispositioned, in the exemplary embodiment under discussion, in a common, vertical central plane 13. The outer surfaces 11*a* and 12*a* of both of the rolls 11 and 12, respectively, and which outer surfaces are formed of a suitable metal, are provided with throughpassage holes or bores 11*b* and 12*b*, respectively, essentially uniformly distributed over the entire jacket surface of the related rolls 11 and 12. The not particularly referenced internal space or compartment of the hollow rolls 11 and 12 are sealingly closed at both end faces thereof. The jackets or outer surfaces 11*a* and 12*a* of the rolls 11 and 12 are provided externally thereof with a deformable, porous, air and vapor permeable sleeve, each of which can be formed for instance by a so-called "Molton". To improve clarity of illustration these sleeves have been conveniently omitted from the drawing. The internal diameter of each sleeve is somewhat larger than the external diameter of the related outer surface or jacket 11*a* and 12*a* of the rolls 11 and 12 and is biased towards the outside by any suitable elastic tensioning elements, for instance compression springs.

At a side element 5 of the frame 4 there is secured an electric motor which in conjunction with a transmission or gearing and operating elements forms a drive device or drive means for rotating the rolls 11 and 12. Any suitable drive arrangement can be employed for rotating the rolls, and further details of one possibility have been disclosed in my co-pending United States application Ser. No. 4912, filed Jan. 18, 1979, entitled "Ironing Machine", to which reference may be readily had and the disclosure of which is incorporated herein by reference. At one of the side elements 5 there is arranged for each roll a suction device 15 which is operatively connected by means of sealed rotational connections 14 with the hollow compartments of both rolls 11 and 12. There can be beneficially employed as the suction devices multi-stage radial blowers, by way of example.

The ironing machine furthermore will be seen to possess four heating elements 21 which are displaceably guided, horizontally and at right angles to the roll axes, by means of guide elements in guides of the side elements 5. By means of suitable adjustment elements, for instance constituting pneumatic or hydraulic piston- and -cylinder units secured non-displaceably at the side element 5, and the piston rods of which are fixedly connected with the heating elements 21, it is possible to shift the heating elements along the guides and to retain such in different selected positions, as explained more fully in my aforementioned co-pending application. Each of both rolls 11 and 12 has operatively associated therewith two respective heating elements 21 which are located to different sides of the central plane 13 and symmetrically arranged with respect thereto and separated from one another by a not particularly referenced intermediate space. The second roll 12 and both of the heating elements 21 operatively associated with such roll 12 are separated from the first roll 11 and the heating elements 21 coacting with such roll 11 likewise by an intermediate space.

The heating elements 21 possess sealed passageways or passages 21*a* for the throughflow of a hot flow medium. Each of the simplified shown passageways 21*a* can be constituted by a pipe or half of a pipe which is soldered or welded or otherwise suitably affixed in a serpentine-shaped course at the side of the wall of the heating element 21 which forms the heating surface 21*b* confronting the related roll, and which side faces away from the related roll 11 or 12. At the upper ends of the passageways 21*a* there are provided inlet connections 21*e* and at the lower end outlet connections 21*f*. The heating surfaces 21*b* essentially form part of a circular cylindrical surface and thus are of arcuate-shaped cross-sectional configuration. The axes of the heating surface-circular cylinder extend essentially parallel to the roll axes. If the heating elements 21 are located in the work position shown in FIG. 1, then the axes of the heating surface-circular cylinder at least approximately coincide with the roll axes. Stated in another way: when the heating elements are located in their work position, then the heating surfaces 21*b* extend approximately coaxially with respect to the rolls 11 and 12 and their roll axes. The heating surfaces 21*b* extend over a sector angle which is in the order of about 120° and 170° and, by way of example, amounts to for instance about 140°. At the edges of the heating surfaces 21*b* which extend essentially parallel to the roll axes there merge rounded transition surfaces or rounded portions. The walls of the heating elements 21 which face away from the rolls 11 and 12 are insulated towards the outside by any suitable and therefore not particularly illustrated thermal insulation means.

The first lower roll 11 is entrained by narrow, mutually parallely extending first transport bands or belts 31 which are spaced from one another so as to form therebetween intermediate spaces. The second upper roll 12 is correspondingly entrained by second spaced transport bands or belts 32. The transport bands 31 and 32 extend over the related rolls 11 and 12 through a sector angle which amounts to approximately 310°. At the mutually confronting sides of both rolls 11 and 12 the transport bands 31 and 32 do not bear against the related rolls 11 and 12 and are guided by the illustrated but not particularly referenced guide rolls in such a manner that they extend through the intermediate space which is present between both of the rolls 11 and 12 and the related heating elements 21. At the region of the intermediate space between the lower and the upper heating elements 21 there is provided to both sides of the vertical central plane 13 a respective support member 41 and 42. The support member 41 located at the left-hand side of the central plane 13 of the drawing forms the support and slide surface for the textile pieces which are to be infed and ironed, one such textile piece having been designated by reference character 53. On the other hand, the other support member 42 forms the support and slide surface for the ironed textile pieces, and one such ironed piece has been illustrated at the right-hand showing of the drawing and designated by reference character 55.

The ironing machine 3 furthermore comprises a thermally insulating casing or housing 7 which is formed of plates detachably secured at the frame 4. These plates can be formed, for instance, from a poor heat conducting fiber material, such as asbestos, or also from a multilayer composite material. The casing 7 encloses the rolls 11 and 12 and the heating elements 21 approximately at all sides and forms an essentially closed cabin. The side walls of the casing 7 which extend parallel to the central plane 13 are however formed by a respective upper and lower plate, between which there are provided at the region of the support members 41 and 42 essentially horizontal slots 7*a* for the infeed and removal of the textile pieces. Furthermore, the floor portion of the casing 7 is provided with an opening 7*b*.

An air infeed line or conduit, generally designated in its entirety by reference character 61, possesses an air inlet 62. This air inlet 62 is located slightly below the ceiling 2*a* of the room or space 2 in which there is erected the ironing machine 3. The section of the air infeed line or conduit 61 which follows the inlet 62 contains a valve 63 which enables regulating the air infeed continuously between null and a maximum value. Further, there are provided two heat exchangers 64 and 65 which have two respective throughpassages or passageways 64*a*, 64*b* and 65*a*, 65*b* for two flow media between which there is to occur a heat exchange action. The air infeed line or conduit 61, viewed in the direction of flow, initially passes through the passage 64*a* of the heat exchanger 64 and then through the passage 65*a* of the heat exchanger 65. Arranged after the heat exchanger 65 is a pump 66 in the air infeed line 61. The outlet mouth or opening 67 of the air infeed line or conduit 61 leads through the opening 7*b* of the casing 7 into the internal space or compartment which is delimited by this casing 7. As apparent from the showing of the drawing, the outlet opening or mouth 67 is located vertically below the lower roll 11 and the heating elements 21 operatively associated therewith and confronts the intermediate space between these heating elements 21.

As previously explained, the hollow compartments or internal spaces of both rolls 11 and 12 are connected by means of suitable rotational connections 14 with a respective suction device 15 which is incorporated into a suction line or conduit, generally designated in its entirety by reference character 71. The outlets of the suction devices 15 are connected by means of a respective line or conduit 72 and a valve 73 with the one connection of the passageway 64*b* of the heat exchanger 64. The part 74 of the suction line 71 which is connected with such heat exchanger 64 leads to the outside area of the building 1 and is equipped at the roof thereof with an outlet 75 opening into the free atmosphere. Further, there is also provided a heater 81 for heating the flow medium serving to heat the heating elements 21. In the embodiment under discussion the heating of the heating elements 21 is accomplished by water vapor and the heater comprises as its primary elements a pump and a steam boiler. The outlet of heater 81 is connected by means of lines or conduits 82 with the inlet connections 21*e* of the heating elements 21. The outlet connections 21*f* of the heating elements 21 are connected by means of lines 83 with the one connection of the passageway 65*b* of the heat exchanger 65. The other connection of the passageway 65*b* is connected by means of a line or conduit 84 with the inlet of the heater 81.

In the description to follow there will now be considered the mode of operation of the ironing installation discussed above which is as follows:

During the operation, the heating elements 21 are located in their work position shown in the drawing. The passageways or chambers 21*a* of the heating elements 21 have infed thereto superheated steam from the heater 81 in the direction of the arrow 85. This superheated steam or vapor, after flowing through the heating elements 21, arrives at the heat exchanger 65, flows through its passageway 65*b* and thereafter flows in the direction of the arrow 87 back to the heater 81. It is here mentioned that the vapor, during its circulation, depending upon the temperature and pressure conditions, can completely or partially condense.

By means of the vapor which flows through the passageways or chambers 21*a* the heating surfaces 21*b* of the heating elements 21 are heated. Both of the rolls 11 and 12 are rotated at the same rotational speed by means of the drive device, but in opposite rotational sense, so that the roll 11 rotates in the direction of the arrow 51 and the roll 12 in the direction of the arrow 52. The transport bands 31 move in the same rotational sense as the roll 11 and the transport bands 32 move in the same rotational sense as the roll 12.

Now if there is placed a textile piece 53 upon the support member 41 and moved manually in the direction of the arrow 54 towards the central plane 13, then it is engaged by portions or sections of the transport bands 31 and thereafter arrives between the roll 11 and the heating surface 21*b* of the heating element 21 located at the bottom left of the showing of the drawing. The textile piece now travels about the roll 11, and it bears at the roll shell over a sector angle of about 300°. Thereafter, this textile piece is transported by the transport bands 31 and 32 to the upper roll 12 and likewise travels about such upper roll. Finally, this textile piece arrives at the support member 42, as indicated by the position of the textile piece 55, and can be removed out of the ironing machine in the direction of the arrow 56.

As already mentioned, each of the rolls is provided with a not particularly illustrated sleeve pressed by springs or the like towards the outside. When no textile piece is disposed between a roll and its related heating surface 21*b* then the sleeve of such roll and the portions of the transport bands which enclose such sleeve bear against the heating surface. A textile piece located between the roll and heating surface is thus heated and also pressed against the roll, such as the roll 11 by the related heating surface 21*b*. The heating elements 21 thus serve both as pressure and pressing or ironing elements.

As will be apparent from the previous description and the showing of the drawing, the textile pieces can be infed to the ironing machine at one side of the vertical central plane 13 extending through the roll axes and can be removed at the other side of the central plane 13 from the ironing machine. This enables the operator to infeed and remove the textile pieces with practically no effort.

The textile pieces are infed in a moist condition for ironing. Upon heating of the textile pieces there thus is formed water vapor. The latter is sucked into the internal spaces or compartments of the rolls 11 and 12 by means of the suction devices 15, through the porous sleeves of the rolls 11 and 12 and through the holes 11*b* and 12*b* of the roll shells 11*a* and 12*a* respectively, and thereafter is conveyed towards the outside by the suction devices 15. These suction devices 15 produce a negative pressure within the internal spaces or compartments of the rolls 11 and 12, so that also air is sucked into the internal compartments of these rolls, and the textile pieces, during their passage through the ironing machine, are drawn snugly against the rolls 11 and 12.

The sucked-up air and water vapor are heated by the heating elements 21 to a temperature which amounts to at least 100° C. The temperature of the heating surfaces 21*b* can amount to, for instance, about 180° C. The sucked-up air and the water vapor are heated to temperatures which are somewhat below the temperature of the heating surfaces 21*b* and can amount to about 120° C. to 160° C. The sucked-up water vapor and the air which is sucked up therewith arrive, under the action of the suction devices 15, at the heat exchanger 64, flow through its passageway or passage 64*b* and are finally ejected through the roof of the building 1 into the atmosphere, as indicated by the arrow 76.

The pump 66 sucks air in the direction of the arrow 68 out of the interior of the room or area 2 through the air inlet 62 into the air infeed conduit or line 61. This air flows through the passages 64*a* and 65*a* of both heat exchangers 64 and 65, respectively, and is thus initially heated by the water vapor-air mixture sucked up out of the hollow rolls 11 and 12 and subsequently heated by the flow medium flowing out of the heating elements 21 to a temperature of for instance 100° C. to 140° C. This hot air flows through the outlet opening or mouth 67 in the direction of the arrow 69 into the internal compartment or space of the casing 7, and specifically, towards the intermediate space which is present below the roll 11 between both of the heating elements 21 which are operatively associated with this roll 11. From the internal compartment of the casing 7 the hot air is then at least in part sucked-up into the hollow compartments or spaces of the rolls 11 and 12. The quantity of air infed through the air infeed line or conduit 61 is preferably larger than the air quantity which is sucked-up in the rolls 11 and 12, so that some hot air flows through the slots 7*a* out of the internal compartment of the casing 7.

The air which is sucked-up out of the immediate region of the rolls 11 and 12 into their hollow compartments is therefore already hot before it arrives at the heating surfaces 21*b*. Further, the textile pieces to be ironed are likewise already preheated by the hot air which is located in the internal compartment of the casing 7, before such textile pieces come into contact with the heating surfaces 21*b*. It is therefore possible to iron the textile peices with a relatively high rotational speed of the rolls 11 and 12.

If the ironing machine is to be cleaned, and particularly the heating surfaces 21*b*, then it is possible to remove the casing 7 and to displace the heating elements 21 by means of the adjustment elements along the horizontal guides away from the rolls 11 and 12.

Of course, it is possible to modify the ironing installation of the exemplary embodiment discussed above, without departing from the basic teachings of the present invention, in a number of different ways. For instance, the heater 81 of course can be simultaneously connected to a number of ironing machines and also can be connected at different machines. Furthermore, the heater 81 can be readily arranged in a different room or area from that where there is located the ironing machine. Moreover, the heating elements 21 can be heated with superheated water or with oil instead of water vapor.

The air infeed line or conduit 61 could be provided in addition to the outlet mouth or opening 67 or instead of such, with outlet mouths or openings located at the region of the intermediate space which is present between the two heating elements 21 belonging to the lower roll 11 and the two heating elements 21 belonging to the upper roll 12. Moreover, depending upon the arrangement of the outlet mouths the casing 7 is not absolutely necessary. Additionally, the heat exchanger 65 is not absolutely required. Furthermore, the axes of the rolls 11 and 12 need not be absolutely located in a vertical plane, rather can be offset with respect to one another in horizontal direction.

While there are shown and described present preferred embodiments of the invention, it is to be distinctly understood that the invention is not limited thereto, but may be otherwise variously embodied and practiced within the scope of the following claims. Accordingly,

What I claim is:

1. An ironing installation comprising:

an ironing machine, said ironing machine including at least one rotatably mounted roll, a pair of heating elements having heating surfaces cooperating with said at least one rotatably mounted roll and serving to heat the textile pieces which are to be ironed and to press such textile pieces against such roll, the heating surface of each heating element enclosing a sector angle of said roll of at least 120°, said roll having an outer surface provided with holes, a casing at least partly enclosing said roll and said heating elements;

a suction device provided with a suction line operatively associated with the outer surface of the roll provided with said holes;

a first heat exchanger having two passageways for two flow media whose thermal energy is to be exposed to a heat exchange action;

an air infeed line;

one of said two passageways of said heat exchanger defining a first passageway forming part of said air infeed line;

said air infeed line containing an air inlet, a pump and at least one outlet mouth;

said outlet mouth opening into the casing of the ironing machine at the neighborhood of the roll and the heating element; and the other passageway of the heat exchanger being incorporated into the suction line.

2. The ironing installation as defined in claim 1, further including:

a heater for heating a flow medium to produce a hot flow medium;

said heating element being provided with an inlet connected with the heater in order to heat said heating element with the hot flow medium and with an outlet;

a second heat exchanger having two passageways for two flow media whose thermal energy is to be exposed to a heat exchange action;

one of said passageways of said second heat exchanger being incorporated into said air infeed line and the other of said passageways being connected with the outlet of the heating element.

3. The ironing installation as defined in claim 1, wherein:

the one passageway of the second heat exchanger is incorporated between the first heat exchanger and the outlet mouth of the air infeed line at said air infeed line.

4. The ironing installation as defined in claim 1, wherein:

said ironing machine includes two of said rotatable rolls arranged in superimposed relation, each roll having a horizontal axis of rotation located in a common, essentially vertical plane;

the pair of heating elements associated with each roll being located at opposite sides of said vertical plane; and infeed and outfeed slots for the textile pieces disposed in said casing on respective sides of the vertical plane and at a horizontal location between the axes of rotation of the rolls.

5. The ironing installation as defined in claim 1, wherein:

said pair of heating elements are located at opposite sides of an essentially vertical plane extending through the axis of the roll; and an intermediate space being formed between the heating elements operatively associated with the roll both at the upper and lower sides of said roll.

6. A method of operating an ironing installation containing an ironing machine, comprising the steps of:

providing an ironing machine containing at least one rotatable roll and at least one coacting heating element in order to heat textile pieces which are to be ironed and a casing at least partly enclosing said roll and heating element;

said roll having an outer surface provided with holes through which air and vapors formed during ironing can be sucked-off;

operating the ironing machine in a room of a building;

sucking-off air out of the room of the building;

feeding the sucked-off air into a heat exchanger;

sucking an air-vapor mixture out of the roll;

feeding the air-vapor mixture sucked out of the roll into said heat exchanger;

pre-heating the air sucked out of the room in the heat exchanger by the air-vapor mixture sucked out of the roll before such pre-heated air is infed to the ironing machine; and feeding the pre-heated air into said casing whereby the air and vapors sucked through the holes in said roll are predominantly said pre-heated air and ironing vapors.

7. The method as defined in claim 6, further including the steps of:

withdrawing the air-vapor mixture coming from the roll and fed through the heat exchanger into the surroundings of the building.

* * * * *